US005767428A

United States Patent [19]

Bloch

[11] Patent Number: 5,767,428

[45] Date of Patent: Jun. 16, 1998

[54] DRUM PEDAL SUPPORT

[76] Inventor: Soren Bloch, 455 Glass Mountain Rd., St. Helena, Calif. 94574-9732

[21] Appl. No.: 557,838

[22] Filed: Nov. 14, 1995

[51] Int. Cl.[6] ..... G10D 13/02

[52] U.S. Cl. ..... 84/422.1; 84/DIG. 25

[58] Field of Search ..... 84/422.1, 422.2, 84/422.3, 225, 229, DIG. 25, 746, 721

[56] References Cited

U.S. PATENT DOCUMENTS 3,677,128 7/1972 Simpson ..... 84/422.1

*Primary Examiner*—Cassandra C. Spyrou
*Attorney, Agent, or Firm*—Limbach & Limbach, LLP

[57] ABSTRACT

A foot pedal assembly has a rigid foot plate with its heel end pivotally supported on a pivot axis which is above the plane of the heel end.

12 Claims, 1 Drawing Sheet

DRUM PEDAL SUPPORT

BACKGROUND OF THE INVENTION

The present invention relates to a foot pedal of the type which may be used with a drum or other instrument.

Foot pedals are well known, such as for drummers and percussionists who use pedals to play the bass drum and the high-hat cymbals, for example. A typical foot pedal comprises a metal plate having a heel end which rests on the ground and is connected by a hinge to a toe end, which angles up off the ground and is coupled to an instrument in some operative way. For example, a bass drum may be hit with a padded striker which is pivotally attached to the toe end by a cam, chain or the like, so that when the toe end is pushed down, the striker hits the drum. Likewise, the top high-hat cymbal may be directly coupled to the toe end so that when the toe end is pushed down, the top high-hat cymbal closes onto the lower high-hat cymbal.

One problem associated with such conventional foot pedal constructions is that the user's entire leg moves up and down and the lower leg moves back and forth to operate the pedal since the user's heel on the ground. It would be desirable to have a foot pedal which allowed movement only by the foot to operate the coupled instrument.

SUMMARY OF THE INVENTION

The present invention is a foot pedal utilizable for operating an instrument. In its broadest form, a rigid foot plate has its heel end pivotally supported on an axis which is above the plane of the heel end.

In the preferred embodiment, a base plate has a U-shaped support bracket affixed to it with two arms extending upwardly therefrom. A foot plate also has a U-shaped support bracket affixed to a heel portion of the foot plate and with two arms extending upwardly therefrom. The arms of the support brackets are pivotally coupled together thereby providing a pivot axis which is above the plane of the heel portion.

Preferably, the foot plate support bracket is adjustably affixed to the foot plate, and both support arms have adjustment positions whereby the location of the pivot axis may be changed.

A better understanding of the features and advantages of the present invention will be obtained by reference to the following detailed description of the invention and accompanying drawings which set forth an illustrative embodiment in which the principles of the invention are utilized.

DETAILED DESCRIPTION OF THE INVENTION

Figure 1:
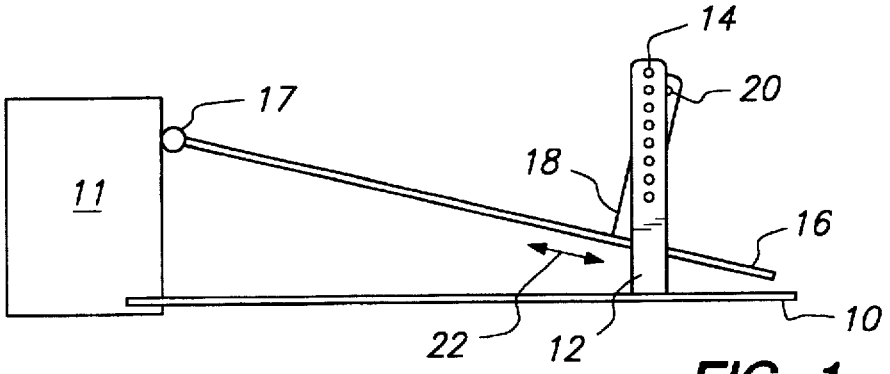
FIG. 1 is a schematic side plan view of a foot pedal in accord with the present invention.

Referring now to FIG. 1, the present invention is presented schematically. A base plate 10 rests on the ground in close proximity to a foot-operable instrument 11. A support bracket 12 or base bracket is rigidly attached to the base plate 10 and has a plurality of adjustment holes 14 disposed vertically on an upright or arm portion of the base bracket.

A foot plate 16 is coupled to the instrument 11 at its toe end in some operative manner at coupling 17 by one of many well-known techniques.

The foot plate 16 also has a support bracket 18 or foot bracket which is similar to base bracket 12 and which is attached to the foot plate. The foot bracket 18 has a plurality of adjustment holes 20 disposed vertically on an upright or arm portion of the foot bracket.

A pivotal connection is provided between the foot bracket 18 and the base bracket 12 such that the foot bracket pivots on the base bracket on an axis which is parallel to the ground or base plate 10, but also above the plane of the foot plate 16, for example, approximately coaxial with the user's ankle. The location of the pivot axis may be fixed, or preferably, it is adjustable by means of the adjustment holes 14 in the base bracket and the adjustment holes 20 in the foot bracket.

It is also preferable that the foot bracket 18 be adjustable laterally along the length of foot plate 16, for example, in the direction indicated by arrow 22.

Figure 2:
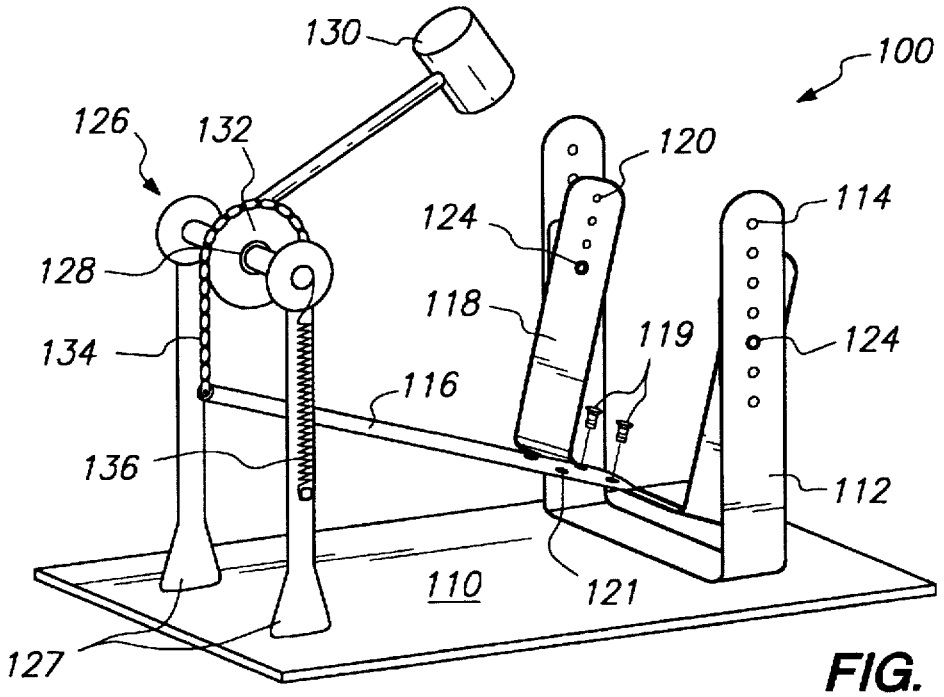
FIG. 2 is one embodiment of a foot pedal in accord with the present invention.

Referring now to FIG. 2, the preferred embodiment for a drum pedal 100 is shown. The drum pedal 100 includes a metal base plate 110. A base bracket 112 is rigidly mounted on the base plate 110, for example, by metals screws or weldment. The base bracket 112 is a piece of ¼ inch steel strap or equivalent cast structure measuring approximately 1½ inches wide by 24 inches long and bent into a U-shape to provide a opening between upright portions of approximately 7⅝ inches. A plurality of holes 114 are symmetrically provided on the upright portions of base bracket 112.

A foot plate 116 has a foot bracket 118 rigidly mounted to the heel end of the foot plate, for example, by metal screws 119. However, it is preferred that the foot bracket 118 be movable laterally along the foot plate 116. Therefore, a plurality of holes 121 are provided in the foot plate 116 so that the position of the foot bracket 118 relative to the foot plate may be adjusted.

The foot bracket 118 is constructed in a U-shape similarly to the base bracket 112 and it is adapted to fit between the upright portions of the base bracket. In the preferred embodiment, the opening between upright portions of the foot bracket 118 is 6 inches. A plurality of holes 120 are symmetrically provided on the upright portions of foot bracket 112 for position adjustment.

The foot bracket 118 is connected to the base bracket 112 by pivotal connections 124 which extend through corresponding adjustment holes on the upright portions of both the base bracket and the foot bracket. The position at which the pivot occurs, i.e. the pivot axis, can be varied by selecting different combinations of the adjustment holes. The selection of position for the pivot axis will be determined by the user based on experience and comfort. I have found that a position which is coaxial with the user's ankle will generally provide maximum comfort and usefulness.

A conventional striker assembly 126 is coupled to the toe end of the drum pedal 100 and includes uprights 127 which are affixed to the base plate 110 and an axle 128 which is rotatably mounted between the uprights. A striker 130 is rigidly connected to the axle 128. A gear 132 is also rigidly connected to the axle 128 and is driven by a short length of chain 134 which is connected at one end to the foot plate 116 and at the other end to the gear 132. A spring 136 is coupled to the axle 128 to bias the striker in a retracted position. Upon pressing down the foot pedal 116, the chain 134 rotates the gear 132 and striker 130 to contact the bass drum surface (not shown). Upon releasing the foot pedal 116, the bias spring 136 rotates the gear 132 and striker 130 away from the bass drum surface.

Figure 3:
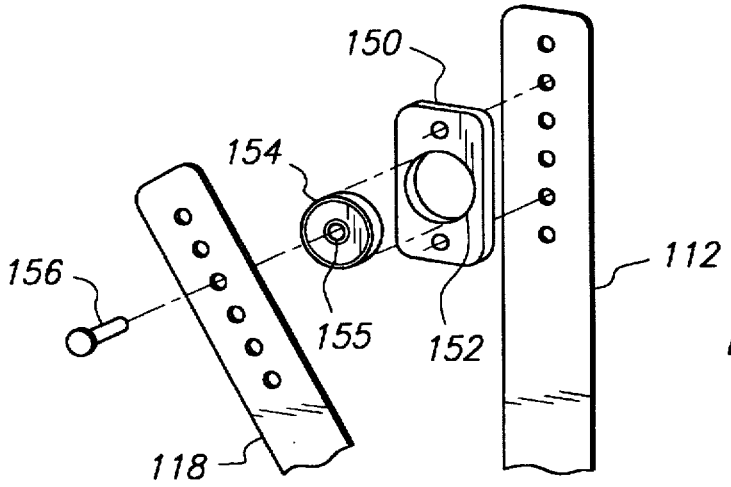
FIG. 3 is an exploded detail view of the pivotal connection between the foot bracket and the base bracket.

Referring now to FIG. 3, the preferred embodiment of the pivotal connection 124 is illustrated in greater detail. A solid metal plate 150 is coupled to the adjustment holes 114 in base bracket 112, for example by nut and bolt. A ball bearing assembly has a cylindrical retaining cup 152 centrally affixed on the metal plate 150, for example by weldment, and a ball bearing ring 154 which fits within the retaining cup 152. The ring 154 has a central opening 155 for receiving an axle therein as is well known. Such ball bearing assemblies are conventional and readily available, such as a "SUF" or "NTN" single row radial double sealed bearing having a ¼ inch inside diameter and ¾ inch outside diameter. A hinge pin 156 is inserted through one of the adjustment holes 120 in foot bracket 118 and into the central opening 155 in ring bearing 154. Thus, the position of metal plate 150 can be adjusted vertically on base bracket 112. Likewise, the position of the hinge pin 156 can be adjusted vertically on foot bracket 118. In this way, the pivot axis may be located for maximum comfort and usefulness according to the preference of the user.

It should be understood that the invention is not intended to be limited by the specifics of the above-described embodiment, but rather defined by the accompanying claims.

I claim:

1. A foot pedal utilizable for operating an instrument, comprising:

a base plate, a first support bracket affixed to the base plate and having an arm extending upwardly therefrom;

a foot plate having a toe portion and a heel portion, a second support bracket affixed to the heel portion of the foot plate and having an arm extending upwardly therefrom, and means for pivotally coupling the arm of the second support bracket to the arm of the first support bracket.

2. A foot pedal as in claim 1, wherein the second support bracket is adjustably affixed to the foot plate.

3. A foot pedal as in claim 1, wherein the pivotal coupling means is adjustable along both arms.

4. A foot pedal, comprising:

a base plate, a first pair of support arms affixed in a spaced apart relationship on the base plate and extending upwardly therefrom, a foot plate, a second pair of support arms affixed in a spaced apart relationship on the foot plate and extending upwardly therefrom, and means for pivotally coupling the second pair of support arms to the first pair of support arms.

5. A foot pedal as in claim 4, wherein the second pair of support arms are adjustably affixed to the foot plate.

6. A foot pedal as in claim 5, wherein each of the second pair of support arms has corresponding adjustment positions vertically disposed thereon.

7. A foot pedal as in claim 4, wherein the pivotal coupling means is adjustable along both the first and second pair of support arms.

8. A foot pedal as in claim 7, wherein each of the first pair of support arms has corresponding adjustment positions vertically disposed thereon and each of the second pair of support arms has corresponding adjustment positions vertically disposed thereon.

9. A foot pedal utilizable for operating an instrument, comprising:

a foot plate having a toe end and a heel end, means rigidly affixed to the heel end and extending upwardly therefrom for supporting the heel end from above without interfering with a user's heel as placed on the foot plate, and means coupled to the supporting means for providing a pivotal axis in a fixed position above the heel end.

10. A foot pedal as in claim 9, wherein the fixed position of the supporting means is adjustable.

11. A foot pedal as in claim 9, wherein the fixed position of the supporting means defines the axis as being substantially coaxial with a user's ankle.

12. A foot pedal as in claim 9, wherein supporting means is adjustable in a horizontal manner along a length of the foot plate.

* * * * *